US009679725B2

(12) United States Patent
Park

(10) Patent No.: US 9,679,725 B2
(45) Date of Patent: Jun. 13, 2017

(54) MAGNETIC SWITCH

(71) Applicant: LSIS CO., LTD., Anyang-si, Gyeonggi-do (KR)

(72) Inventor: Jinhee Park, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/985,182

(22) Filed: Dec. 30, 2015

(65) Prior Publication Data

US 2016/0314917 A1 Oct. 27, 2016

(30) Foreign Application Priority Data

Apr. 23, 2015 (KR) ..... 10-2015-0057325

(51) Int. Cl.
*H01H 3/00* (2006.01)
*H01H 33/74* (2006.01)
(Continued)

(52) U.S. Cl.
CPC ..... *H01H 33/74* (2013.01); *H01H 50/18* (2013.01); *H01H 50/20* (2013.01); *H01H 50/36* (2013.01);
(Continued)

(58) Field of Classification Search
CPC ..... H01H 50/16; H01H 50/20; H01H 51/01; H01H 51/22; H01H 51/2209; H01F 5/02–2005/027; H01F 2007/1692
(Continued)

(56) References Cited

U.S. PATENT DOCUMENTS 3,119,341 A 1/1964 Hirano et al.
6,911,884 B2 * 6/2005 Uotome ..... H01H 47/06 335/132
(Continued)

FOREIGN PATENT DOCUMENTS

FR 2865313 7/2005
JP U404654 2/1940
(Continued)

OTHER PUBLICATIONS

European Patent Office Application No. 16151544.0, Search Report dated Oct. 7, 2016, 9 pages.
(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

The present invention relates to a magnetic switch, and more particularly, a magnetic switch capable of preventing degradation of breaking efficiency by utilizing magnetic force to the utmost, in a manner of matching contact centers of fixed and movable cores. A magnetic switch according to one embodiment includes a bobbin provided with a cylindrical body and a plurality of flanges and having a coil wound on an outer circumferential surface thereof, a fixed core fixed to an inside of the cylindrical body with a predetermined spaced interval from the cylindrical body, and a movable core slidably installed in the cylindrical body and contactable with or separated from the fixed core, wherein a guide portion protrudes from a lower portion of the cylindrical body along an inner circumferential surface of the cylindrical body, such that the movable core can linearly move along a central axis of the fixed core.

4 Claims, 5 Drawing Sheets

(51) Int. Cl.
*H01H 50/18* (2006.01)
*H01H 50/36* (2006.01)
*H01H 50/20* (2006.01)
*H01H 51/06* (2006.01)

(52) U.S. Cl.
CPC ..... *H01H 51/065* (2013.01); *H01H 2205/002* (2013.01)

(58) Field of Classification Search
USPC ..... 335/185
See application file for complete search history.

(56) References Cited

U.S. PATENT DOCUMENTS 7,876,183 B2 * 1/2011 Uruma ..... H01H 50/04 335/126
8,138,863 B2 * 3/2012 Tanaka ..... H01H 1/54 335/126
8,138,872 B2 * 3/2012 Yoshihara ..... H01F 7/1615 335/124
8,198,964 B2 * 6/2012 Yoshihara ..... H01H 51/29 335/131
8,269,585 B2 * 9/2012 Choi ..... H01H 1/2008 335/126
8,274,347 B2 * 9/2012 Eum ..... H01H 9/341 335/156
8,395,463 B2 * 3/2013 Ito ..... H01H 9/34 335/202
8,642,906 B2 * 2/2014 Yeon ..... H01H 50/023 200/430
9,064,664 B2 * 6/2015 Yamamoto ..... H01H 1/32
9,082,576 B2 * 7/2015 Nishimura ..... H01H 50/643
9,196,442 B2 * 11/2015 Ito ..... H01H 50/54
9,269,507 B2 * 2/2016 Enomoto ..... H01H 50/546
2006/0050466 A1 * 3/2006 Enomoto ..... H01H 50/02 361/160
2009/0322453 A1 * 12/2009 Kawaguchi ..... H01F 7/1615 335/81
2011/0156845 A1 * 6/2011 Eum ..... H01H 50/56 335/154
2013/0012037 A1 * 1/2013 Enomoto ..... H01H 9/443 439/39
2013/0057369 A1 * 3/2013 Yano ..... H01H 1/66 335/156
2013/0342293 A1 12/2013 Yamamoto et al.

FOREIGN PATENT DOCUMENTS

JP U5311062 7/1951
JP 2001357767 12/2001
JP 2005277308 10/2005
JP 2005331104 12/2005
JP 2011204374 10/2011

OTHER PUBLICATIONS

Japan Patent Office Application No. 2016-009634, Office Action dated Feb. 14, 2017, 2 pages.

* cited by examiner

MAGNETIC SWITCH

CROSS-REFERENCE TO RELATED APPLICATION

Pursuant to 35 U.S.C. §119(a), this application claims the benefit of earlier filing date and right of priority to Korean Patent Application No. 10-2015-0057325, filed on Apr. 23, 2015, the contents of which are hereby incorporated by reference herein in its entirety.

BACKGROUND OF THE INVENTION

1. Field of the Invention

This specification relates to a magnetic switch, and more particularly, a magnetic switch, capable of preventing degradation of breaking efficiency by utilizing magnetic force (magnetism) as much as possible, in a manner of matching contact centers of a fixed core and a movable core with each other.

2. Background of the Invention

In general, a magnetic switch or a direct current (DC) relay is a type of an electric circuit switch which transfers mechanical driving force and a current signal using a principle of an electromagnet, and installed in various industrial facilities, machines, vehicles and the like.

Specifically, a relay for an electric vehicle is disposed in a battery system of an electric vehicle, such as a hybrid vehicle, a fuel cell vehicle, a golf cart and an electric forklift truck, to serve to switch on or off a flow of a main current.

FIG. 1 is a longitudinal sectional view of a magnetic switch according to the related art, and FIG. 2 is an exploded perspective view of FIG. 1.

A configuration and a fabricating process of the related art magnetic switch are described as follows. An arc chamber 2 with a fixed contact 1, a movable shaft assembly 4 with a movable contact 3, a plate 5, a fixed core 6 and a movable core 7 are sequentially laminated in a downward direction. A lower end portion of the movable shaft 8 is completely fixed to the movable core 7 in a laser-welding manner. The upper arc chamber 2 is welded onto the plate 5 by laser beams so as to fully seal a space where the fixed contact 1 and the movable contact 3 operate. Also, the fixed core 6 and the movable core 7 are covered with a cylinder 9. The cylinder 9 is then air-tightly welded onto a lower portion of the plate 5. A coil assembly 5*a* wound with a coil 5*b* and a yoke 5*c* are coupled to the lower portion of the plate 5.

In the magnetic switch, a magnetic path is formed along the plate 5, the yoke 5*c*, the movable core 7 and the fixed core 6, by a magnetic field generated in the coil 5*b*. In this instance, the movable core 7 is attracted to the fixed core 6 by a magnetic force generated in the fixed core 6. Responsive to this, the movable shaft 8 fixed to the movable core 7 is moved to push up the movable contact 3 coupled to an upper portion of the movable shaft 8. Accordingly, the movable contact 3 is brought into contact with the fixed contact 1 such that a current can flow therealong.

In the related art magnetic switch, the arc chamber 2 is filled therein with arc-extinguishing gas, and thus should have a sealed structure. Also, the fixed core 6 and the movable core 7 should have their centers accurately matching each other to prevent a loss of magnetic force.

Here, the cylinder 9 is fabricated by pressing, called deep drawing. However, in view of a characteristic of the pressing process, the structure of the cylinder 9 is made by pressing down a raw material. Accordingly, the material of the cylinder has a slightly inclined (tilt) angle, failing to be formed in an accurately straight form (form a right angle). This may be likely to cause interference between a lower portion of the cylinder 9 and the movable core 7. Such interference has been avoided in a manner that an outer diameter of the movable core 7 is slightly smaller than an inner diameter of the cylinder 9.

However, in this instance, abrasion due to friction between the movable core 7 and the cylinder 9 in case of a long-term use may be caused due to a gap present between the movable core 7 and the cylinder 9. That is, a problem of residual iron powders which fell from components of the movable core 7 and the cylinder 9 is caused. In addition, a failure of a uniform linear motion of the movable core is caused, which results in non-use of magnetic force to the utmost, and degradation of breaking efficiency (performance), such as an increase in a breaking time or a generation of a voltage loss.

SUMMARY OF THE INVENTION

Therefore, to obviate the aforementioned drawbacks, an aspect of the detailed description is to provide a magnetic switch, capable of utilizing magnetic force as much as possible, by matching contact centers of a fixed core and a movable core with each other.

To achieve these and other advantages and in accordance with the purpose of this specification, as embodied and broadly described herein, there is provided a magnetic switch including a bobbin provided with a cylindrical body and a plurality of flanges, and having a coil wound on an outer circumferential surface of the cylindrical body, a fixed core fixed to an inner side of the cylindrical body with being spaced apart from the cylindrical body with a predetermined interval, and a movable core slidably installed in the cylindrical body and contactable with or separated from the fixed core, wherein a guide portion protrudes from a lower portion of the cylindrical body along an inner circumferential surface of the cylindrical body, such that the movable core is linearly moved along a central axis of the fixed core.

Here, an outer circumferential surface of the movable core may be uniformly maintained without a step or inclination along a lengthwise direction of the movable core.

An inner diameter of the guide portion may be the same as an outer diameter of the movable core.

An inner diameter of the guide portion may be smaller than an outer diameter of the fixed core.

A length of the guide portion may be shorter than a length of the movable core.

An upper end of the guide portion and an upper end of the movable core may be located at the same position in an open state.

The guide portion may be provided with a plurality of spline grooves formed along a lengthwise direction of the guide portion.

In a magnetic switch according to each exemplary embodiment disclosed herein, a guide portion for a movable core is formed on an inner circumferential surface of a bobbin so as to guide the movable core to linearly move along a central axis of a fixed core. This may allow for matching central axes of the movable core and the fixed core with each other, thereby exhibiting an optimized breaking performance without a loss of an operation time in a manner of utilizing magnetic force as much as possible without a voltage loss.

With a removal of a cylinder and a common use of the fixed core, a number of components required can be reduced, which may result in reducing fabricating costs and simplifying an assembling process.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given of preferred configurations of the present invention, with reference to the accompanying drawings. However, those preferred embodiments of the present invention are merely illustrative to help those skilled in the art easily practice the invention, but should not be construed to limit the technical scope of the present invention.

Figure 1:
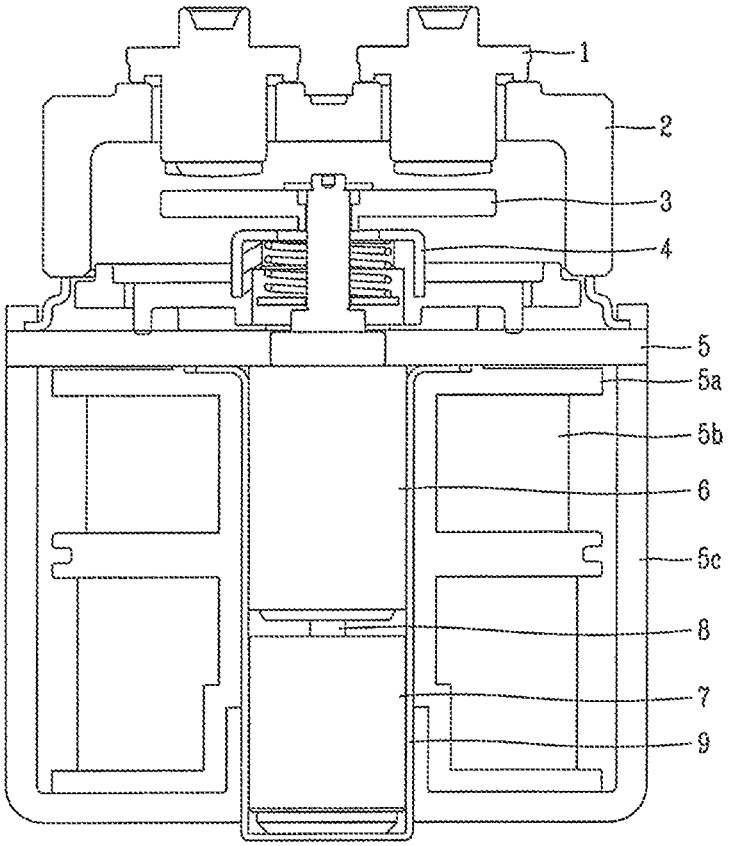
FIG. 1 Prior Art
FIG. 1 is a longitudinal sectional view of a magnetic switch according to the related art.
Figure 2:
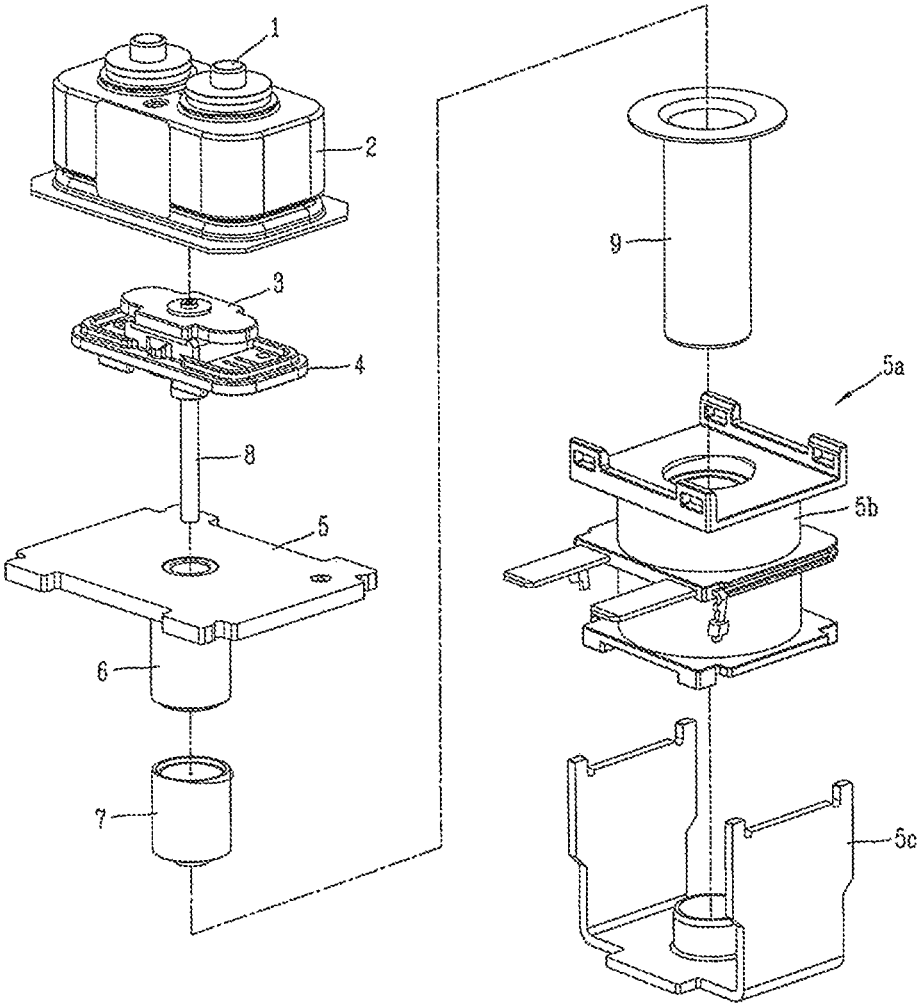
FIG. 2 Prior Art
FIG. 2 is an exploded perspective view of FIG. 1.
Figure 3:
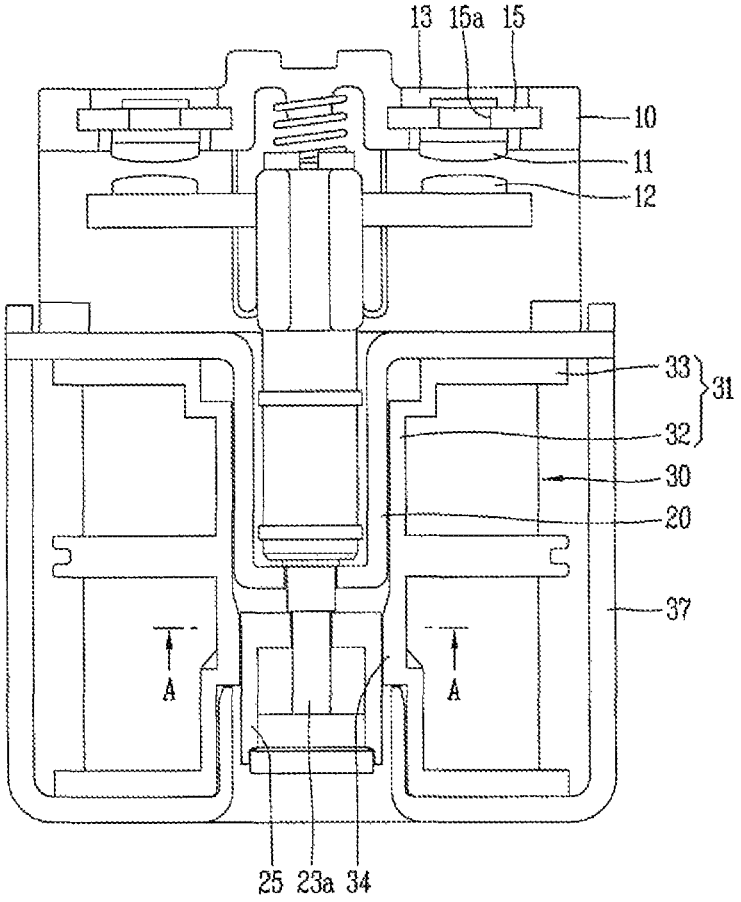
FIG. 3 is a longitudinal sectional view of a magnetic switch in accordance with one exemplary embodiment of the present invention.
Figure 4:
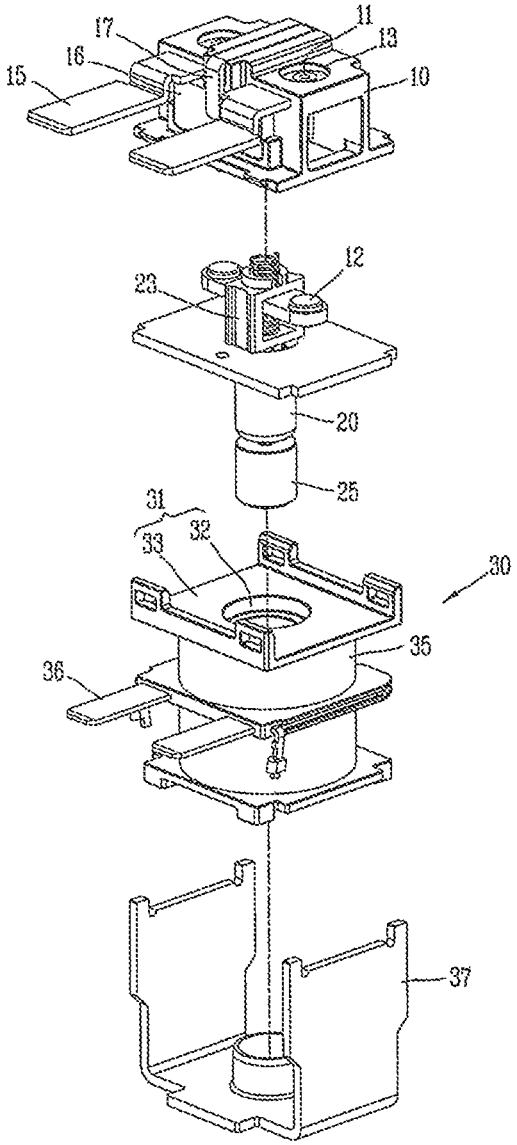
FIG. 4 is an exploded perspective view of FIG. 3.
Figure 5:
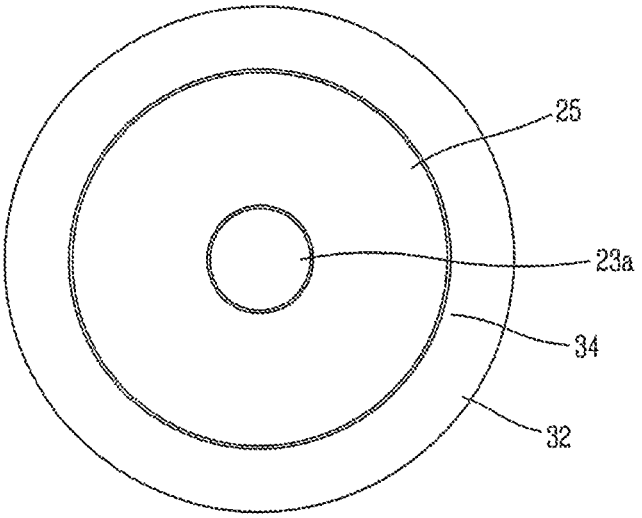
FIG. 5 is a sectional view of a part A-A of FIG. 3.

FIG. 3 is a longitudinal sectional view of a magnetic switch in accordance with one exemplary embodiment of the present invention, FIG. 4 is an exploded perspective view of FIG. 3, and FIG. 5 is a sectional view of a part A-A of FIG. 3. Hereinafter, a magnetic switch according to one exemplary embodiment of the present invention will be described in detail with reference to the drawings.

A magnetic switch in accordance with one exemplary embodiment disclosed herein includes a bobbin 31 provided with a cylindrical body 32 and a plurality of flanges 33 and having a coil 35 wound on an outer circumferential surface of the cylindrical body 32, a fixed core 20 fixed to an inner side of the cylindrical body 32, and a movable core 25 slidably installed in the cylindrical body 32 of the bobbin 31 and contactable with or separated from the fixed core 20. A guide portion 34 protrudes from a lower portion of the cylindrical body 32 along an inner circumferential surface of the cylindrical body 32, such that the movable core 25 can linearly move along a central axis of the fixed core 20.

An upper frame 10 may be formed approximately in a shape of a box with a lower surface open. The upper frame 10 may be formed of a synthetic resin material, such as plastic and the like. The upper frame 10 may be made in an injection-molding manner.

A pair of contact holes 13 in which fixed contacts 11 are disposed is formed at an upper surface of the upper frame 10.

Terminals 15 or bus bars which are connected to the fixed contacts 11, respectively, may be inserted into a front surface of the upper frame 10. Each terminal 15 may be formed of a material with high conductivity, such as silver (Ag) and the like. Also, a through hole 15*a* through which the fixed contact 11 is insertable may be formed through a part of each terminal 15.

Permanent magnets 16 may be disposed at front and rear surfaces of the upper frame 10. Permanent magnet holders 17 for fixing the permanent magnets 16, respectively, may be provided at an upper portion of the upper frame 10.

The pair of fixed contacts 11 are terminals which are inserted through the through holes 15*a* of the terminals 15 and contact holes 13 of the upper frame 10 so as to be exposed to an outside of the upper frame 10, and connectable to a power source or a load. The pair of fixed contacts 11 may be made of a material with high conductivity, such as copper (Cu) and the like. Upper end portions of the pair of fixed contacts 11 may be connected to the power source or the load and lower end portions thereof may come in contact with a movable contact 12.

The movable contact 12 is a terminal which is inserted into the upper frame 10 and is brought into contact with or separated from the pair of fixed contacts 11. The movable contact 12 is brought into contact with the lower end portions of the pair of fixed contacts 11, as aforementioned. The movable contact 12 includes a plate body formed in a flat shape and having a predetermined thickness, and a pair of contact portions contactable with the pair of fixed contacts 11. The movable contact 12 is fixed to a shaft 23 installed in a coil assembly 30. Accordingly, as the shaft 23 is linearly moved in an axial direction, the movable contact 12 may be brought into contact with or separated from the pair of fixed contacts 11. When the movable contact 12 comes in contact with the pair of fixed contacts 11, a circuit may be closed such that a current can flow. When the movable contact 12 is separated from the pair of fixed contacts 11, the circuit may be open such that a current flow can be blocked.

The coil assembly 30 is configured to generate a magnetic field by control power. The coil assembly 30 supplies magnetic force using a principle of an electromagnet. The coil assembly 30 may include a bobbin 31, a coil 35, a coil terminal 36, and the like.

The bobbin 31 is a structure of supporting and configuring the coil assembly 30. The bobbin 31 may be provided with a cylindrical body 32, and a plurality of flanges 33 formed at a periphery of the cylindrical body 32. The bobbin 31 may be formed of a synthetic resin material, such as plastic and the like. Accordingly, it may generate less friction even though contacting the fixed core 20 and the movable core 25, resulting in reduced abrasion. The fixed core 20 and the movable core 25 are inserted into the cylindrical body 32, and the coil 35 is wound on an outer circumferential surface of the cylindrical body 32.

The coil 35 receives external control power supplied through the coil terminal 36. When the power is supplied to the coil 35, a magnetic field is generated around the coil 35.

The fixed core 20 is fixedly inserted into the cylindrical body 32. The fixed core 20 is provided to increase magnetic flux density in a manner of being magnetized within the magnetic field generated around the coil 35. The fixed core 20 may be integrally formed with a plate located between the upper frame 10 and a yoke 37. That is, an upper surface of the fixed core 20 may be configured as a flange. The fixed core 20 may be formed of an iron material. Here, the fixed core 20 is spaced apart from the cylindrical body 32 by a predetermined distance, so as to be free from friction against the cylindrical body 32. Accordingly, abrasion and the like due to opening/closing impact are not caused. Also, a cylinder component of the related art can be removed, and the fixed core 20 with the same size as that of the related art can be used without being adjusted to correspond to the cylindrical body 32, resulting in a reduction of design and fabrication costs.

The movable core 25 is slidably installed below the fixed core 20. The movable core 25 is coupled to a lower end portion 23*a* of the shaft 23 so as to be movable along with the shaft 23. The movable core 25 may also be formed of an iron material, similar to the fixed core 20.

The shaft 23 is inserted through centers of the fixed core 20 and the movable core 25. The movable core 25 is fixedly coupled to the lower end portion 23*a* of the shaft 23, and the shaft 23 is slidably installed in the fixed core 20.

A guide portion 34 may protrude from an inner circumferential surface of the cylindrical body 32. The guide portion 34 is provided to support the movable core 25 and guide a movement of the movable core 25, which will be explained later. An outer circumferential surface of the movable core 25 is uniformly maintained along a lengthwise direction of the movable core 25 without a step or inclined angle.

An inner diameter of the cylindrical body 32 may be the same as an outer diameter of the movable core 25. Accordingly, when the movable core 25 is moved, the movable core 25 can perform a uniform linear motion according to the guide of the guide portion 34.

An inner diameter of the guide portion 34 may be smaller than an outer diameter of the fixed core 20. This may allow the guide portion 34 to have a sufficient thickness so as to provide a stable supporting force.

The guide portion 34 may be formed of a synthetic resin material and the like. Thus, when the guide portion 34 comes in contact with the movable core 25, less friction and less abrasion of components may be enabled.

The movable core 25 can be linearly moved along a central axis by the guide portion 34. Accordingly, when the movable core 25 is attracted to the fixed core 20, a loss of magnetic force can be minimized, thereby maintaining a stable breaking performance.

The guide portion 34 may be formed smaller than the movable core 25 in length. This may result in a reduction of a contact area between the guide portion 34 and the movable core 25, minimizing friction therebetween. Of course, the length of the guide portion 34 may be decided within a range without losing the supporting force by the guide portion 34.

In an open state, an upper end of the guide portion 34 and an upper end of the movable core 25 may be located at the same position (same height). Accordingly, a contact area between the guide portion 34 and the movable core 25 may be reduced during a breaking operation, resulting in a reduced friction. Also, the upper end portion of the guide portion 34 may be formed to be inclined. This may allow for increasing the supporting force of the guide portion 34 and reducing contact resistance at the upper end portion.

Figure 6:
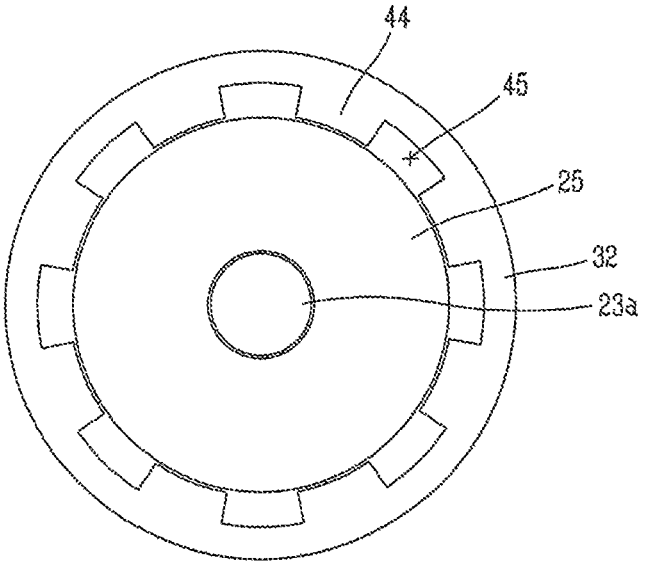
FIG. 6 is a sectional view of a part A-A in a magnetic switch in accordance with another exemplary embodiment of the present invention.

FIG. 6 illustrates a magnetic switch in accordance with another exemplary embodiment of the present invention. A guide portion 44 is provided with a plurality of spline grooves 45 formed along a lengthwise direction thereof. This may reduce a contact surface of the guide portion 44 with the movable core 25 with increasing rigidity of the guide portion 44, which can arouse a reduction of friction.

In a magnetic switch according to each exemplary embodiment disclosed herein, a guide portion for a movable core is formed on an inner circumferential surface of a bobbin so as to guide the movable core to linearly move along a central axis of a fixed core. This may allow for matching central axes of the movable core and the fixed core with each other, thereby exhibiting an optimized breaking performance without a loss of an operation time in a manner of utilizing magnetic force as much as possible without a voltage loss.

With a removal of a cylinder and a common use of the fixed core, a number of components required can be reduced, which may result in reducing fabricating costs and simplifying an assembling process.

Iron powders which are generated between the movable core and the cylinder or misaligned (non-matched) coupling which takes place in the related art can be avoided.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. Therefore, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A magnetic switch comprising:

a bobbin having a cylindrical body and a plurality of flanges with a coil wound on an outer circumferential surface of the cylindrical body;

a fixed core fixed to an inner side of the cylindrical body;

a movable core slidably installed in the cylindrical body such that it contacts or separates from the fixed core; and a guide portion that protrudes from a lower portion of the cylindrical body along an inner circumferential surface of the cylindrical body, wherein the fixed core is spaced apart from the cylindrical body by a predetermined distance, wherein the movable core is linearly moved along a central axis of the fixed core, wherein a length of the guide portion is shorter than a length of the movable core such that a portion of the movable core is spaced apart from the cylindrical body, and wherein the inner surface of the guide portion entirely contacts the movable core in a closed or open state of the magnetic switch.

2. The magnetic switch of claim 1, wherein an outer circumferential surface of the movable core is uniform without a step or inclination along a lengthwise direction of the movable core.

3. The magnetic switch of claim 1, wherein an inner diameter of the guide portion is smaller than an outer diameter of the fixed core.

4. The magnetic switch of claim 1, wherein an upper end of the guide portion and an upper end of the movable core are located at a same position in the open state.

* * * * *